US010173124B2

(12) United States Patent
Jon

(10) Patent No.: US 10,173,124 B2
(45) Date of Patent: Jan. 8, 2019

(54) RETRACTABLE INLINE SKATE SHOE

(71) Applicant: Young Taek Jon, Busan (KR)

(72) Inventor: Young Taek Jon, Busan (KR)

( * ) Notice: Subject to any disclaimer, the term of this patent is extended or adjusted under 35 U.S.C. 154(b) by 0 days.

(21) Appl. No.: 15/832,870

(22) Filed: Dec. 6, 2017

(65) Prior Publication Data

US 2018/0243637 A1 Aug. 30, 2018

(30) Foreign Application Priority Data

Feb. 28, 2017 (KR) ..... 10-2017-0027757

(51) Int. Cl.

| | |
|---|---|
| ***A63C 17/00*** | (2006.01) |
| ***A43B 5/16*** | (2006.01) |
| ***A63C 17/06*** | (2006.01) |
| ***A63C 17/22*** | (2006.01) |

(52) U.S. Cl.

CPC ..... *A63C 17/008* (2013.01); *A43B 5/1641* (2013.01); *A63C 17/06* (2013.01); *A63C 17/226* (2013.01); *A63C 2203/10* (2013.01)

(58) Field of Classification Search

CPC ..... A63C 17/008; A63C 17/06; A63C 17/226; A63C 17/061; A63C 17/067; A63C 17/20; A43B 5/1641; A43B 2203/10; A63B 2203/10

See application file for complete search history.

(56) References Cited

U.S. PATENT DOCUMENTS

| | | | | |
|---|---|---|---|---|
| 5,803,469 | A * | 9/1998 | Yoham | A63C 17/008 280/11.27 |
| 2003/0011151 | A1* | 1/2003 | Lai | A63C 17/008 280/11.223 |
| 2003/0025285 | A1* | 2/2003 | Chiu | A63C 17/008 280/7.13 |
| 2004/0140635 | A1* | 7/2004 | Yoo | A43B 5/1633 280/11.231 |
| 2004/0178588 | A1* | 9/2004 | Yoo | A63C 17/008 280/11.221 |
| 2008/0136126 | A1* | 6/2008 | Yang | A63C 17/008 280/11.27 |

(Continued)

FOREIGN PATENT DOCUMENTS

| | | |
|---|---|---|
| KR | 10-0358602 B1 | 10/2002 |
| KR | 20-0325200 Y1 | 9/2003 |

(Continued)

*Primary Examiner* — Brian L Swenson

(74) *Attorney, Agent, or Firm* — KORUS Patent, LLC; Seong Il Jeong

(57) ABSTRACT

Disclosed herein is a retractable inline skate shoe. The retractable inline skate shoe is configured such that: a cavity is formed in the sole of a shoe body; the housing is mounted and fastened in the cavity; a slider is inserted into the housing; a push button is configured to protrude to an outside via a through hole portion formed in a heel of the shoe sole; a number of L-shaped wheel shaft insertion recesses are formed in lower portions of both left and right sides of the slider; a frame is mounted inside the slider; recessed wheel shaft fitting recesses are formed in both side wall surfaces of the frame; two fastening recesses are fastened onto the shoe sole; a guide is inserted into the frame; and the slider containing the frame is fastened into the housing by means of housing fastening plates.

2 Claims, 7 Drawing Sheets

(56) References Cited

U.S. PATENT DOCUMENTS

2011/0025002 A1* 2/2011 Park ..... A43B 5/1633
280/11.19

FOREIGN PATENT DOCUMENTS

| | | | |
|---|---|---|---|
| KR | 20-0326926 | Y1 | 9/2003 |
| KR | 20-0364894 | Y1 | 10/2004 |
| KR | 10-2005-0007862 | A | 1/2005 |
| KR | 10-2005-0035813 | A | 4/2005 |
| KR | 10-2005-0052219 | A | 6/2005 |
| KR | 10-2009-0123380 | A | 12/2009 |

* cited by examiner

RETRACTABLE INLINE SKATE SHOE

BACKGROUND

1. Technical Field

The present invention relates to a retractable inline skate shoe in which an inline skate mounted in the bottom portion of a shoe sole in a lengthwise direction can be selectively projected from and retracted into the shoe sole by a push button, thereby enabling a typical shoe and an inline skate to be selectively used according to the selection of a shoe wearer.

2. Description of the Related Art

Recently, with the popularization of various types of leisure sports, such as water skiing, paragliding, etc., various types of interesting and active leisure sports items have been developed, and thus new leisure sports fields have been activated.

Accordingly, these leisure sports items are intended to enable leisure sports to be easily enjoyed in real life. There are many leisure sports items in which existing leisure sports items or tools are actually applied to daily items. An example of these leisure sports items is a rolling shoe in which an inline or roller skate is applied to a shoe. A conventional rolling shoe is formed by mounting a wheel on the rear portion of the sole of a typical sports shoe in order to enable both the function of a shoe and the function of a roller or inline skate to be performed. Although the conventional rolling shoe is configured to perform the function of an inline or roller skate in addition to the basic function of a sports shoe, the conventional rolling shoe is problematic in that it has a single roller, so that the fun of rolling felt by a user is low and stability is also low because the user needs to ride the rolling shoe while raising the front portion of his or her foot.

SUMMARY

The conventional rolling shoe is formed by mounting a wheel on the rear portion of the sole of a typical sports shoe in order to enable both the function of a shoe and the function of a roller or inline skate to be performed. Although the conventional rolling shoe is configured to perform the function of an inline or roller skate in addition to the basic function of a sports shoe, the conventional rolling shoe is problematic in that it has a single roller, so that the fun of rolling felt by a user is low and stability is also low in use because the user needs to ride the rolling shoe while raising the front portion of his or her foot.

Accordingly, an object of the present invention is to provide a retractable inline skate shoe which is capable of overcoming the above-described problems.

The present invention has been conceived to overcome the above-described problems, and the present invention provides a retractable inline skate shoe which is configured such that an inline skate mounted in the bottom portion of a shoe sole can be selectively projected from and retracted into the bottom surface of the shoe sole by means of a push button installed in the heel of a shoe body. Both a typical shoe function and an inline skate function can be selectively performed, and thus the use of the retractable inline skate shoe is easy and convenient. Accordingly, it is not necessary to separately provide an inline skate and a shoe, and thus the retractable inline skate shoe is very economical and practical.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

The present invention relates to a retractable inline skate shoe equipped with an inline skate, which can be projected and retracted according to the selection of a shoe wearer.

Figure 1:
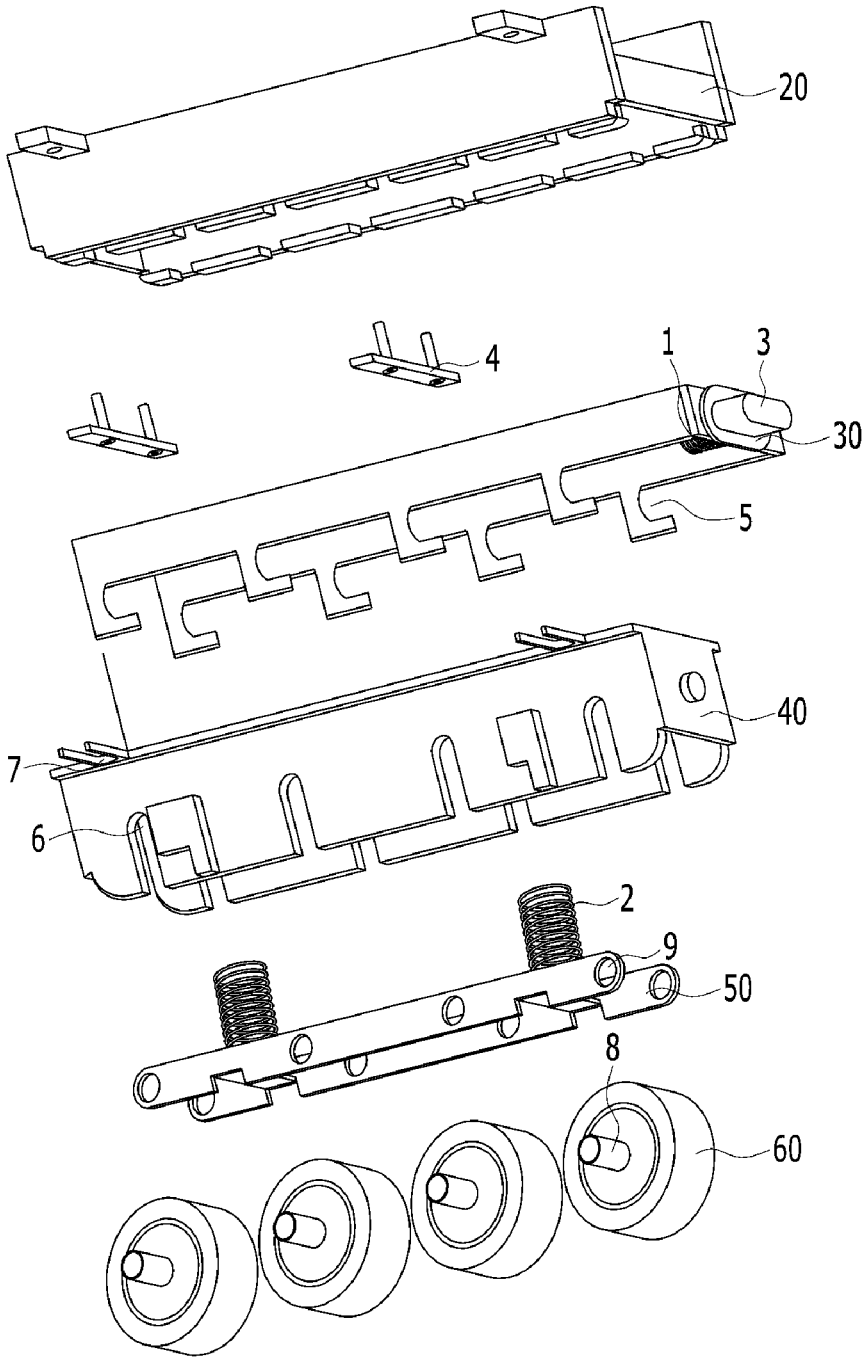
FIG. 1 is a perspective view showing a state in which parts have been separated according to the present invention.
Figure 2:
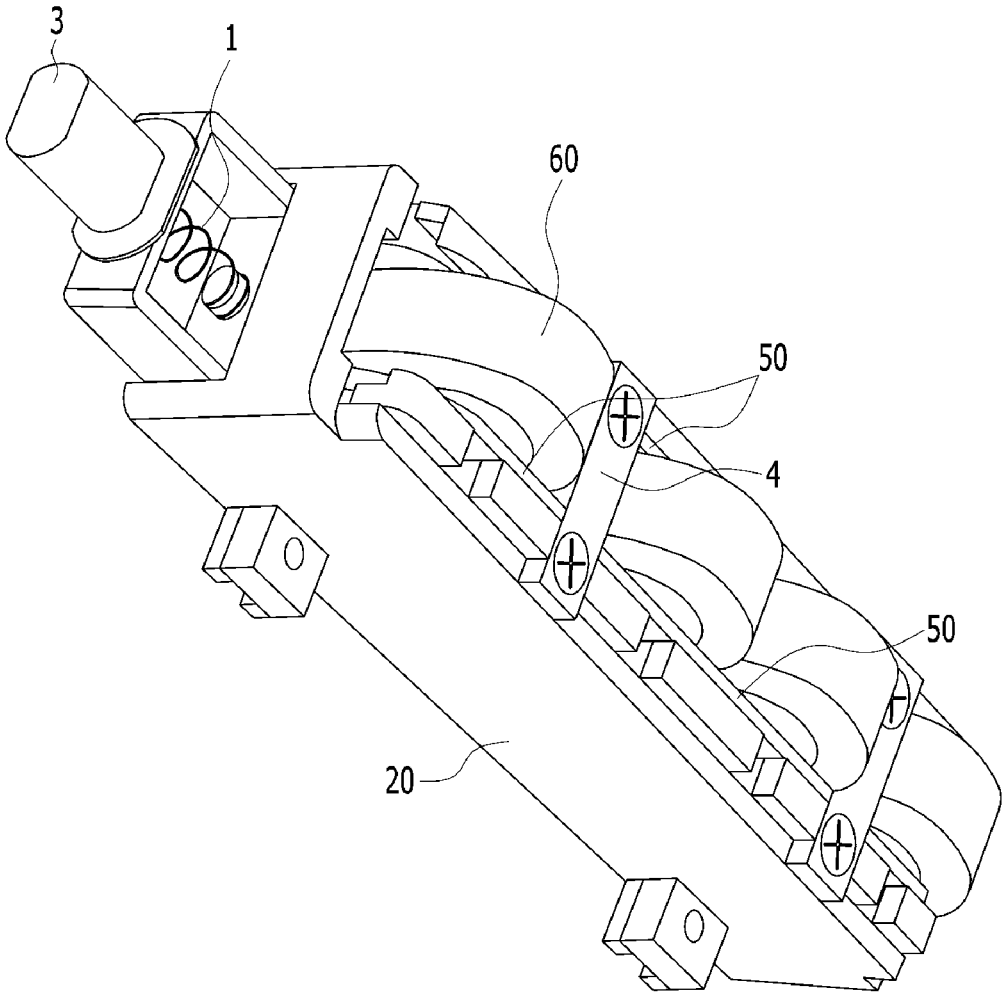
FIG. 2 is a perspective view showing a state in which the parts of FIG. 1 have been assembled together.
Figure 3:
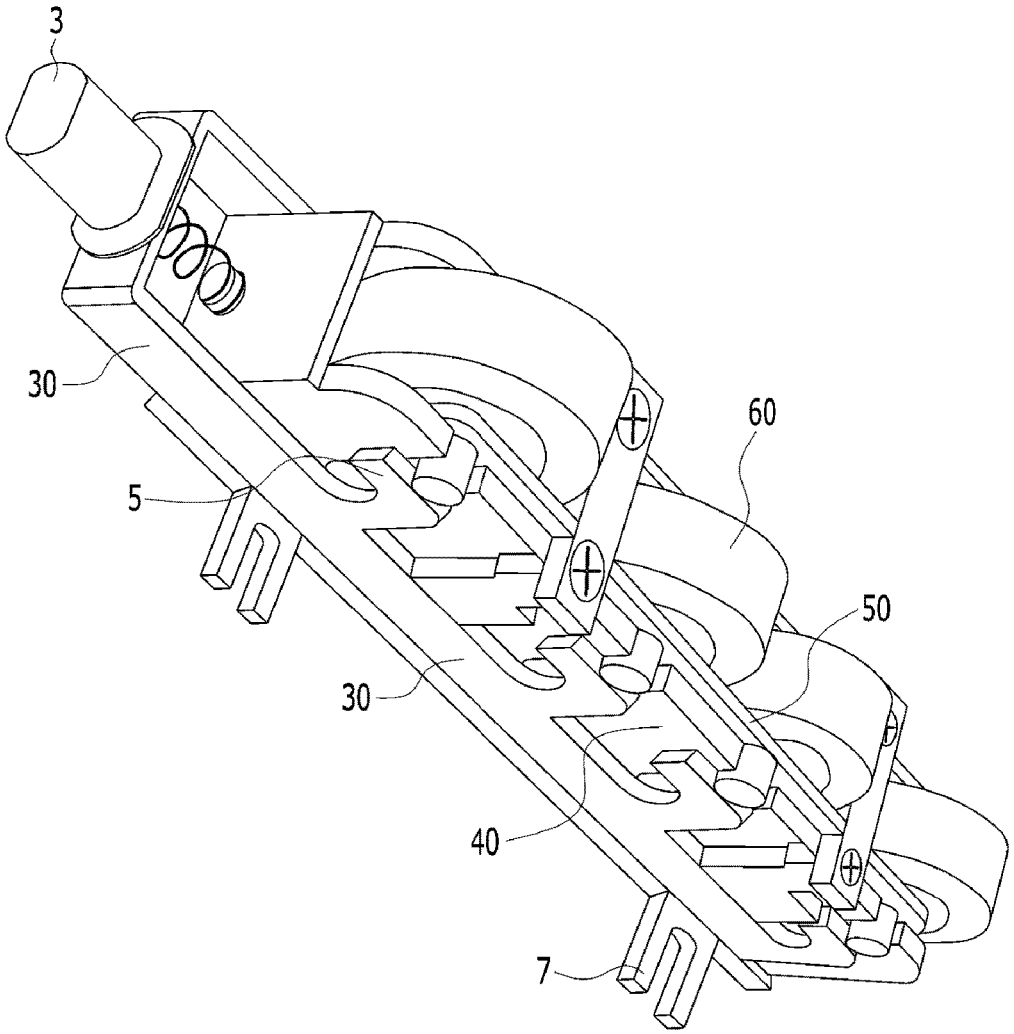
FIG. 3 is a perspective view showing a state in which wheels mounted in the slider of FIG. 2 have been projected.
Figure 4:
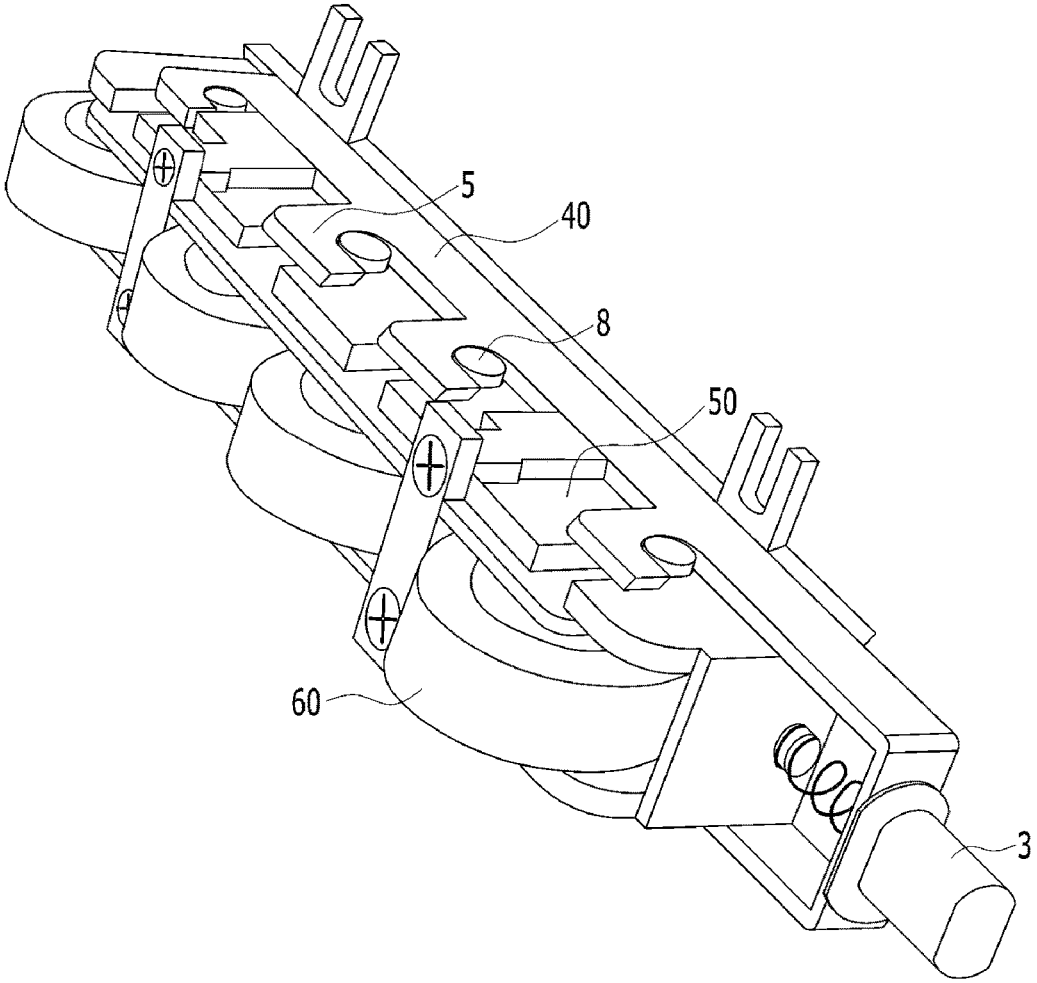
FIG. 4 is a perspective view showing a state in which the wheels mounted in the slider of FIG. 2 have been retracted.
Figure 5:
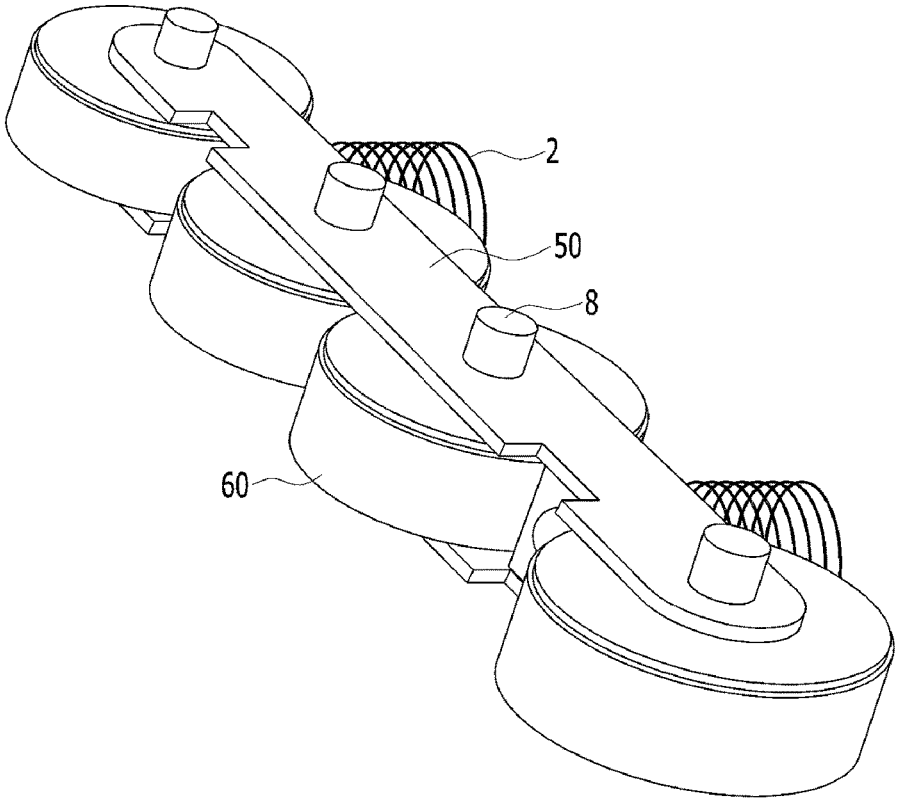
FIG. 5 is an enlarged view showing a state in which the wheels have been coupled to the guide.
Figure 6:
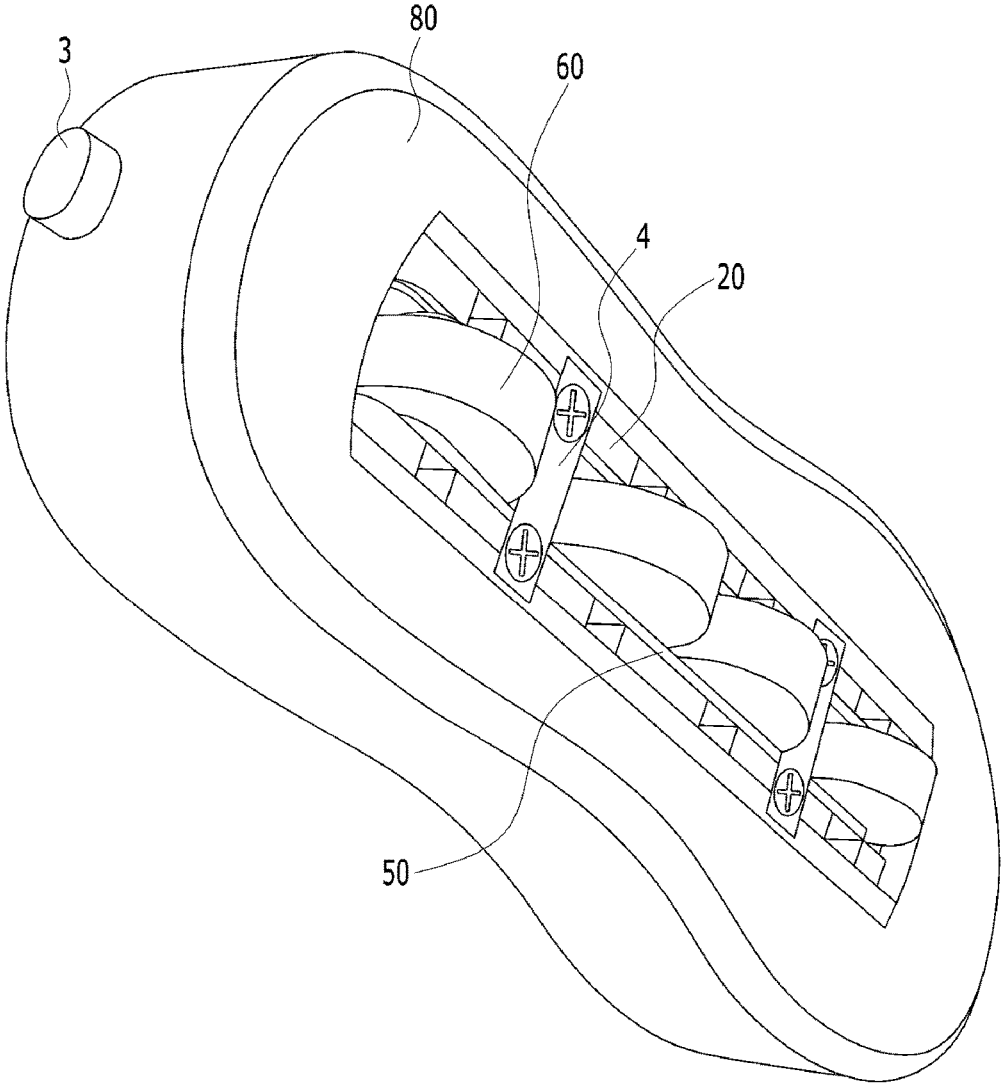
FIG. 6 is an enlarged view showing a state in which an inline skate has been projected from a shoe sole.
Figure 7:
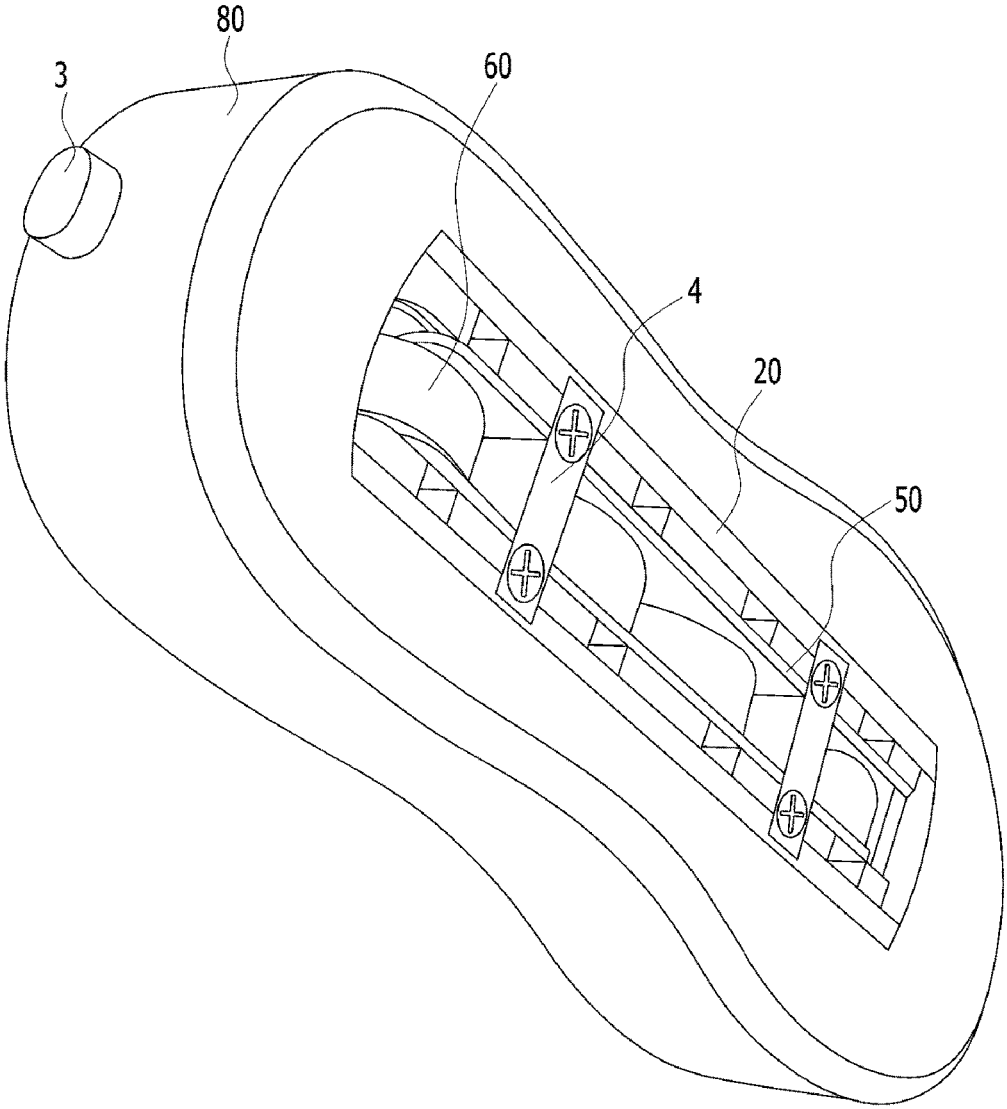
FIG. 7 is an enlarged view showing a state in which the inline skate has been retracted into the shoe sole.

FIG. 1 is a perspective view showing a state in which parts have been separated according to the present invention, FIG. 2 is a perspective view showing a state in which the parts of FIG. 1 have been assembled together, FIG. 3 is a perspective view showing a state in which wheels mounted in the slider of FIG. 2 have been projected, FIG. 4 is a perspective view showing a state in which the wheels mounted in the slider of FIG. 2 have been retracted, FIG. 5 is an enlarged view showing a state in which the wheels have been coupled to the guide, FIG. 6 is an enlarged view showing a state in which an inline skate has been projected from a shoe sole, and FIG. 7 is an enlarged view showing a state in which the inline skate has been retracted into the shoe sole.

The present invention will be described in detail below.

As shown in the accompanying drawings, a cavity is formed in the center of the bottom portion of the sole 80 of a shoe body 100 for an inline skate in a size which enables a housing 20 to be mounted in the cavity; the parallelepiped housing 20 is mounted and fastened inside the cavity; a slider 30 is inserted into the housing 20; the slider 30 is configured such that a pair of side walls are vertically formed on both left and right sides of the slider 30 at a predetermined interval and a push button 3 configured to be elastically moved by a spring 1 in a front-back direction is formed in the back end portion of the slider 30; the push button 3 is configured to protrude to the outside via a through hole portion formed in the heel of the shoe sole 80; a number of L-shaped wheel shaft insertion recesses 5, which is equal to the number of wheels 60 and into which a guide 50 in which wheel shaft fitting holes 9 configured such that the wheels 60 are inserted thereinto are formed is inserted, are formed in the lower portions of both left and right sides of the slider 30 in the back end portion of which the push button 3 is formed; these wheel shaft insertion recesses 5 function such that when a shoe wearer pushes the push button 3, the slider 30 moves forward, wheel shafts 8 are separated from the wheel shaft insertion recesses 5 of the slider 30, and the wheels 60 are made to exit or enter through the bottom of the shoe sole 80 by springs 2 mounted on the top of the guide 50; a frame 40 is mounted inside the slider 30; recessed wheel shaft fitting recesses 6 are formed in both side wall surfaces of the frame 40; two fastening recesses 7 formed at the upper end of an outside surface of the frame 40 are fastened onto the shoe sole 80 by a fastener (not shown); the guide 50 in which the springs 2 configured to elastically move upward are fixedly inserted into both sides of the guide 50 is inserted into the frame 40; and the slider 30 containing the frame 40 into which the guide 50 is inserted is fastened into the housing 20 by means of housing fastening plates 4; thereby forming a structure in which the slider 30, the frame 40, and the guide 50 into which the wheels 60 have been inserted are sequentially inserted into the housing 20.

Furthermore, the wheel shafts 8 around which the respective wheels 60 are fitted are inserted into the wheel shaft fitting recesses 9 formed in the guide 50.

A method of using the embodiment of the retractable inline skate shoe configured as described above is as follows:

The method of using the embodiment of the retractable inline skate shoe is now described. In a state in which the wheels 60 mounted in the guide 50 have been retracted into the housing 20 formed in the bottom portion of the sole 80 of the shoe body 100, a shoe wearer wears the shoe body 100, and the shoe 100 performs a shoe function in daily life. When the shoe wearer desires to ride an inline skate, the wheels 60 mounted in the guide 50 are projected from the housing 20 formed inside the bottom portion of the sole 80 of the shoe body 100 out of the sole 80 by pushing the push button 3 formed in the back end portion of the sole 80 of the shoe body 100, thereby enabling the shoe wearer to ride the inline skate. When the shoe wearer desires to stop inline skating, the shoe wearer pushes the push button 3 inward and, simultaneously, pushes the wheels 60 mounted in the guide 50 by a hand to thus allow the wheels 60 to be retracted into the frame 40, so that the slider 30 inserted into the housing 20 is moved forward and the frame 40 is also moved forward by the elastic action of the spring 1, with the result that the wheel shafts 8 are inserted into the L-shaped wheel shaft insertion recesses 5 formed in the slider 30, thereby enabling the function of a typical shoe to be performed. Accordingly, the retractable inline skate shoe enables the two functions to be conveniently performed.

The present invention relates to the retractable inline skate shoe. The retractable inline skate shoe is configured such that the inline skate mounted in the bottom portion of the shoe sole is selectively projected from and retracted into the shoe sole by means of the push button installed in the heel of the shoe body. The retractable inline skate shoe enables both a typical shoe function and an inline skate function to be used, and is configured such that switching between a typical shoe function and an inline skate function can be conveniently performed according to the selection of a shoe wearer. The retractable inline skate shoe has a simple structure and a convenient method of using it. In particular, it is not necessary to separately provide an inline skate and a shoe, and thus the retractable inline skate shoe is very economical and practical, with the result that the two effects can be achieved at the same time.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A retractable inline skate shoe, wherein:

a cavity is formed in a center of a bottom portion of a sole of a shoe body for an inline skate in a size which enables a parallelepiped housing to be mounted inside the cavity;

the parallelepiped housing is mounted and fastened in the cavity;

a slider is inserted into the housing; the slider is configured such that a pair of side walls are vertically formed on both left and right sides of the slider at a predetermined interval and a push button configured to be elastically moved by a spring in a front-back direction is formed in a back end portion of the slider;

the push button is configured to protrude to an outside via a through hole portion formed in a heel of the shoe sole;

a number of L-shaped wheel shaft insertion recesses, into which a guide is inserted, are formed in lower portions of both left and right sides of the slider, wherein the number of the L-shaped wheel shaft insertion recesses is equal to the number of wheels, and the guide includes wheel shaft fitting holes configured such that the wheels are inserted thereinto;

a frame is mounted inside the slider;

recessed wheel shaft fitting recesses are formed in both side wall surfaces of the frame;

two fastening recesses formed at an upper end of an outside surface of the frame are fastened onto the shoe sole;

the guide in which springs configured to elastically move upward are mounted and the wheel shaft fitting holes configured to receive wheel shafts are formed in side surfaces of the guide is inserted into the frame; and the slider containing the frame into which the guide is inserted is fastened into the housing by means of housing fastening plates.

2. The retractable inline skate shoe of claim 1, wherein the wheel shaft insertion recesses are configured such that, when a shoe wearer presses a push button, the slider moves forward, the wheel shafts are separated from the wheel shaft insertion recesses of the slider, and thus the wheels are projected from a bottom surface of the shoe sole by the springs mounted on the guide, and are also configured such that, when the shoe wearer presses the push button inward and, simultaneously, pushes the wheels mounted in the guide to thus allow the wheels to be retracted into the frame, the slider inserted into the housing is moved forward, the frame is also moved forward by an elastic action of the spring, and thus the wheel shafts are inserted into the L-shaped wheel shaft insertion recesses formed in the slider.

* * * * *